US006047841A

United States Patent [19]

Chen

[11] Patent Number: 6,047,841

[45] Date of Patent: Apr. 11, 2000

[54] ASSEMBLY TYPE TOOLBOX FRAME

[76] Inventor: Kun Chen Chen, No. 6, Lane 609, Sec. 1, Chung Shan Road, Tachia Chen, Taichung Hsien, Taiwan

[21] Appl. No.: 09/218,098

[22] Filed: Dec. 22, 1998

[51] Int. Cl.[7] ..... B65D 6/18

[52] U.S. Cl. ..... 220/7; 220/691; 206/349

[58] Field of Search ..... 220/7, 6, 691; 206/349, 372, 223

[56] References Cited

U.S. PATENT DOCUMENTS

| | | | |
|---|---|---|---|
| 3,675,808 | 7/1972 | Brink | 220/7 |
| 5,450,962 | 9/1995 | Uitz | 220/7 |
| 5,551,568 | 9/1996 | Niles et al. | 220/7 |
| 5,588,549 | 12/1996 | Furtner | 220/7 |
| 5,797,508 | 8/1998 | Loftus et al. | 220/7 |
| 5,918,743 | 7/1999 | Uitz | 220/7 |

*Primary Examiner*—Joseph M. Moy
*Attorney, Agent, or Firm*—Bacon & Thomas, PLLC

[57] ABSTRACT

An assembly type toolbox frame that is incorporated with rear board, bottom casing and front frame as an integral casing can be placed a tray on the top when it is tumbled and folded in vertical state, it can be assembled side boards at both sides and inserted drawers to form a tool cabinet, if it is further fitted a top cover on the top of tool cabinet, it becomes a toolbox that can be locked via latch device. Furthermore, the tray and drawers inside can be connected in series by a pin in order to prevent from being pulled out; under this configuration, each element is assembled by its concave and convex match kit and inlaid structure which form a compound coupling relation with each other.

7 Claims, 5 Drawing Sheets

ASSEMBLY TYPE TOOLBOX FRAME

BACKGROUND OF THE INVENTION

1. Field of the invention

This invention primarily relates to an assembly type toolbox frame manufactured by blow molding, especially it is related to a structure of assembly type toolbox or tool cabinet.

2. Description of the Prior Art

The blow-molded toolbox nowadays is fundamentally united by two or more than two casings through integration, overlap or roll method to constitute a complete toolbox; amid the box, there is a recess molded to contain hand tools.

SUMMARY OF THE INVENTION

The said assembly type toolbox is manufactured by applying blow molding technology and is comprised of front frame, bottom casing, rear board, side board and tray etc. elements. They are joggled together by their molded concave and convex match joints and inlaid structures to construct a basic box frame. Afterward, place drawers inside the box frame to form a tool cabinet. If a top cover is fitted to the tool cabinet, then it is assembled as a toolbox.

The creative goal of this invention is to provide a sort of independent elements by employing blow molding technology and combine the elements via their match joints structure to form a tool cabinet or a tool box.

BRIEF DESCRIPTION OF THE INVENTION

DETAILED DESCRIPTION OF THE PREFERRED EMBODIMENTS

Figure 1:
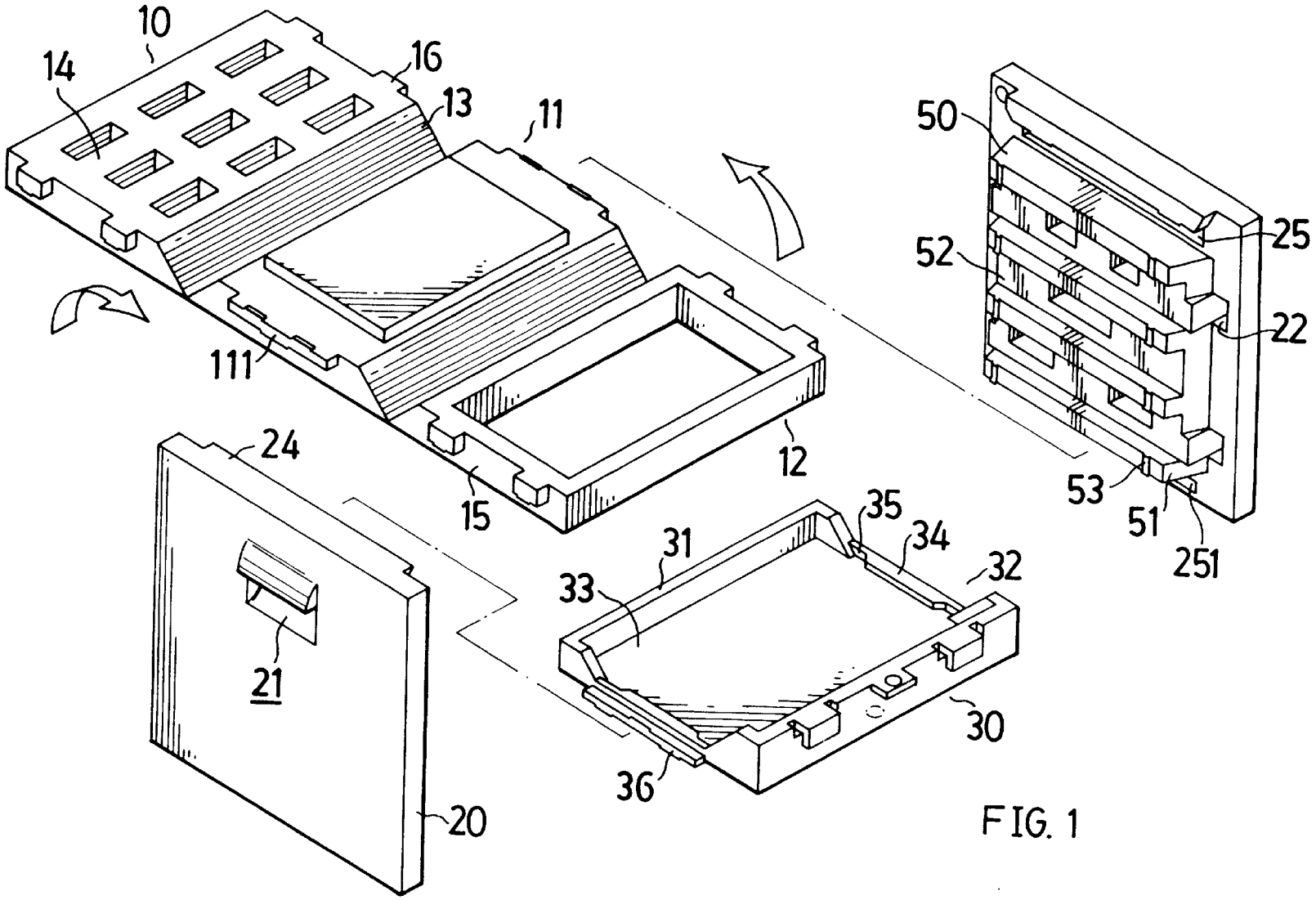
FIG. 1 is a schematic exploded view of the major elements of this invention.

The rear board 10, bottom casing 11, and front frame 12 shown on FIG. 1 can be united as an integral part by applying blow molding technology. Amid the elements, rear board 10 and bottom casing 11 can be incorporated with cross-sliding which reinforced rib 14 to strengthen their rigidity. Also, the opposite side between rear board 10 and bottom casing 11, bottom casing 11 and front frame 12 have sideways 13 in tilt status according to the fitting angle respectively that can access an angular space ranging 90°~120° when each connection joint is at its fully developed state. Afterward, set bottom casing 11 as the base and let rear board 10 and front frame 12 tumble to fold to upright position by following the arrow sign direction, and then place a tray 30 on the top and fit two side boards 20 to the sides so as to complete the semi-close space. The outer surface of side board 20 has a gripping recess 21 where support can stand and force can apply.

Figure 2:
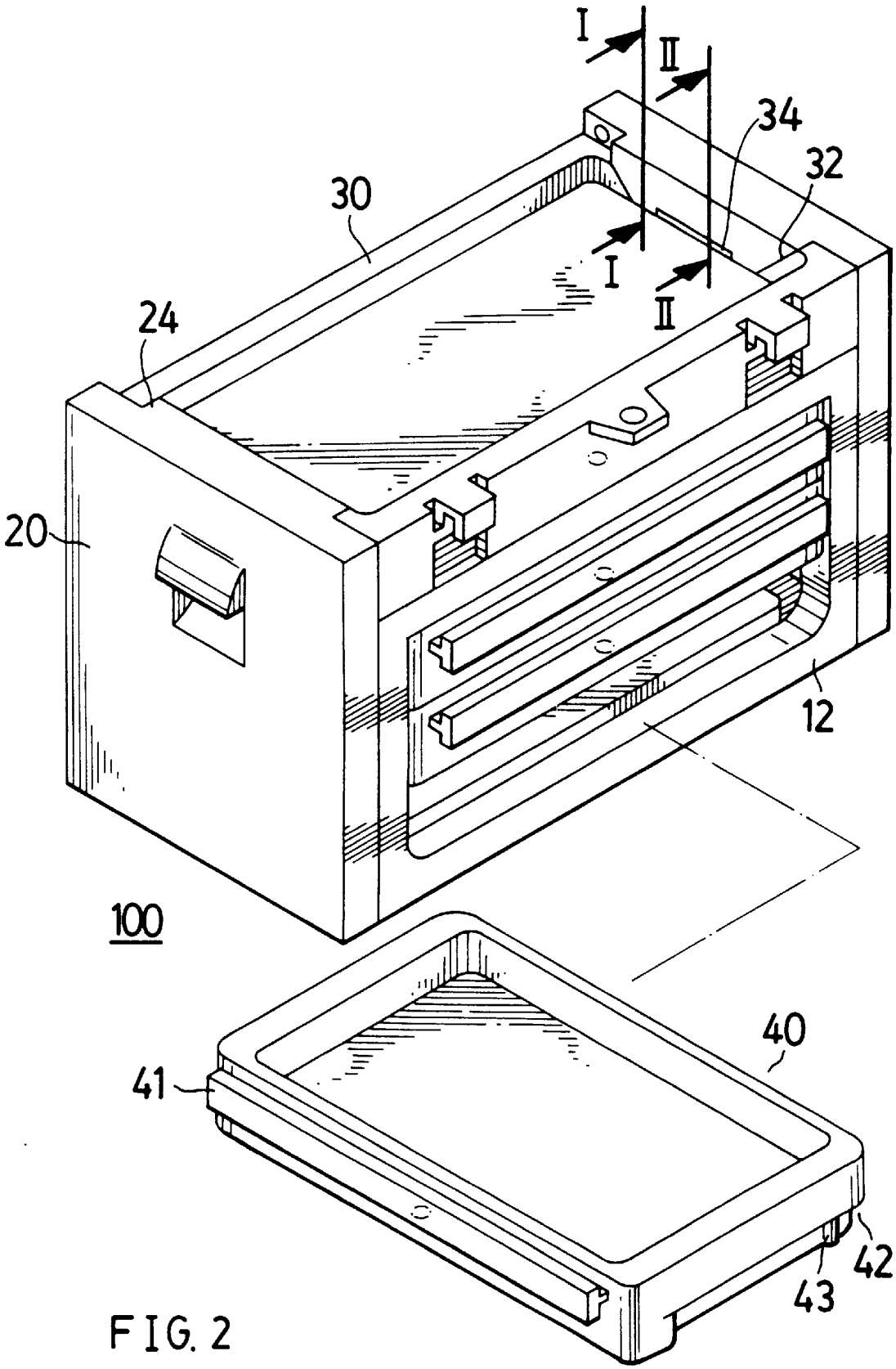
FIG. 2 is a schematic elevational view of the box frame comprised by the elements shown in FIG. 1, it also demonstrates the installation of drawers inside the frame to form a tool cabinet.

Referring to FIG. 2, three drawers 40 have been inserted into the aforementioned semi-close apace through the hollow frame, the front frame12. A tool cabinet 100 now is ready to contain hand tools or apparatus and parts.

Figure 5:
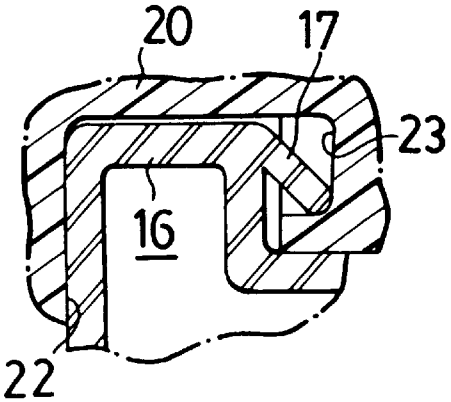
FIG. 5 is an enlarged cross-sectional view of the structure of concave and convex match kit preserved on side board and front frame or rear board to joggle together.

Referring to FIG. 1 and FIG. 5 for further description concerning the coupling relation among rear board 10, front frame 12, and two side boards 20. Amid these elements, there are protuberant bumps 16 projected at side wall 15 by rear board 10 and front frame 12, and each protuberant bump 16 has been fitted hook 17 in tilt status according to the angle setting. There are slots 22 located on the two side boards 20 where the corresponding protuberant bumps 16 can be plugged. Also, there is a joggle slot 23 sited inside the slot 22. Corresponding to hook 17, the protuberant bump 16 and hook 17 can be easily extruded into slot 22 due to its small tip angle; and then hook 17 will rebound to its anchor shape and seize itself to its fix position inside the joggle slot 23. This is the compound type coupling relation derived from concave and convex match kit and joggle joints that is not easy to separate.

Referring to FIG. 1~FIG. 4 for the coupling relation concerning tray 30 and two side boards 20. First of all, FIG. 1 has shown the tray 30 and its vertically erected and surrounded wall 31, the pre-shaped notch 32 fitted at both left and right sides, the coupling bump 34 protruded at tray face corresponding to notch, the coupling slot 35 recessed at two ends of coupling bump 34 individually, the insertion bump 36 in slice shape extended at external base of coupling bump 34 and corresponding to notch 32, the mating bumps 24 extended at two side board 20 to match the notch 32, the adapting slot 25 recessed underneath mating bump 24 where can adapt the insertion bump 36 of tray 30.

In FIG. 2, when tray 30 and two side boards 20 are coupled as one unit, the notch 32 has already been tightly and closely filled with mating bump 24. As shown on FIG. 3, there is tilt anchor 26 fitted at mating bump 24. Corresponding to coupling slot 35, it can be lapped to secure itself at coupling slot 35 and can prevent the separation of coupling bump 34. The semi-circular stop 37 is protruded to insertion bump 36 where is below the corresponding place to the hook 26 and can be extended into adapting slot 25; a joggle slot 23 is recessed inside the adapting slot 25 where can seize the stop 37 from separation.

Figure 4:
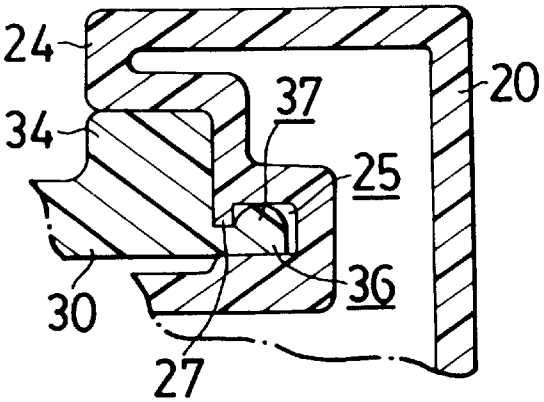
FIG. 4 is an enlarged cross-sectional view taken on line II—II of FIG. 2, it's to show how the structure of concave and convex match kit preserved on side board and tray to joggle together.

FIG. 4 is showing the coupling relation concerning insertion bump 36 and adapting slot 25 when notch 32 is being tightly and closely jointed together without the mating bump 24 and coupling bump 34 being secured at coupling slot 35. Under this configuration, a semi-circular stop 37 is protruded at upper part of insertion bump 36 while a resistant stop 27 is erected at outer edge of adapting slot 25 corresponding to stop 37. Therefore, when insertion bump 36 is being extruded into adapting slot 25, the resistant stop 27 will be match-jointed with stop 27 to further prevent the occurrence of separation.

Figure 3:
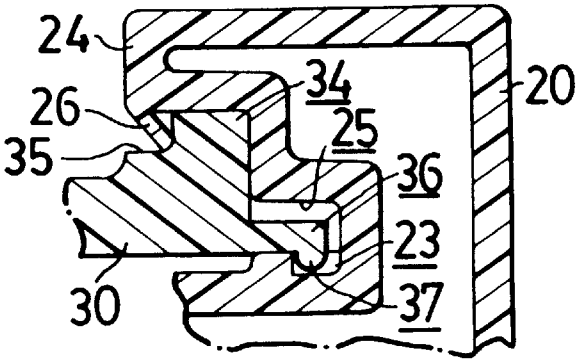
FIG. 3 is an enlarged cross-sectional view taken on line I—I of FIG. 2, it's to show how the structure of concave and convex match kit preserved on side board and tray to joggle together.

As learned from FIG. 3 and FIG. 4, the tray 30 and two side boards 20 in this invention are to take the advantage of the compound type coupling relation derived from concave and convex match kit and joggle joints. They are not easy to fall apart on the ground if accidentally falling down is encountered. Meanwhile, bottom casing 11 and two side boards 20 commonly use stem bump 111 to bind the structure of adapting slot 251 together as an integral part. The structural configuration is the same as the coupling relation between tray 30 and side boards 20 except mating bump 24 is not tightly and closely jointed to the notch. There is no need to further description of the details here.

Figure 8:
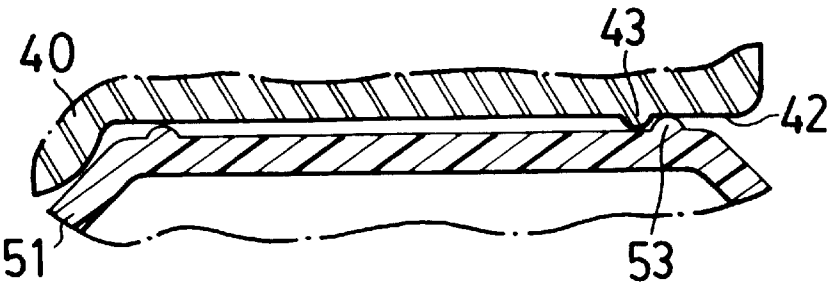
FIG. 8 is a schematic cross-sectional view of the coupling relation between the bottom part at both sides of drawer and the side boards that are related to stopping and preventing their separation.

According to FIG. 1, FIG. 2 and FIG. 8, there demonstrate and describe the coupling relation amid the elements when placing drawers 40 into tool cabinet 100 through front frame 12. FIG. 1 is showing a bracket base 50 extended at side boards 20 and corresponding to mating bump 24. This bracket base 50 has been fitted several props 51 in equal distance interval along the vertical direction of the figure. A guide rail 52 is formed in transversely-grooved shape and in between two props 51. Also, each prop 51 has fitted positioning block 53 in semi-column shape at front and rear ends respectively. The drawers 40 shown on FIG. 2 are rectangular tray-shape container. They are equipped with handle bar 41 in the front and recessed sliding slot 42 at the bottom of right and left sides. A touching block 43 in semi-column shape is protruded adjoining the end of sliding slot 42 and can be extruded when the whole drawers 40 are being inserted into tool cabinet 100 via front frame 12. At this moment, the left and right sides of drawers are just precisely joggled to the guide rail 52 at two side boards in opposite direction that its end sliding slot 42 just right locates on prop 51. In FIG. 8, the touching block 43 located at end of sliding slot 42 is extruded in between prop 51 and two positioning blocks 53. Amid these element, the positioning block 53 (please refer to FIG. 1 ) adjoining rear board 10 is designed for drawers'40 sliding push movement; it is the end of push and can prevent drawers 40 going any further. Another positioning block 53 adjoining front frame 12 will provide a temporary stop function for drawers'40 pulling out movement. In case the touching block 43 has separated from the restricted range, then the whole drawers 40 will be pulled out completely.

Figure 9:
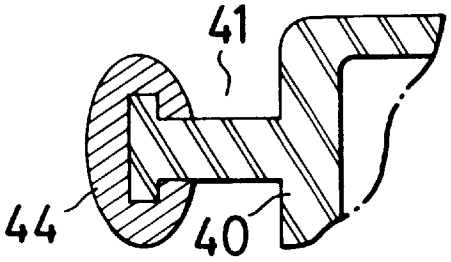
FIG. 9 is a partial cross-sectional view of another preferred embodiment of the handle bar.

FIG. 9 is an exemplar of drawers'40 handle bar 41. In the figure, the handle bar is T-shape and can be connected a guard cover 44 by using wrapping or penetration technology. The outward appearance of guard cover 44 is patterned a rough surface in order to increase the volume of finger-holding.

Figure 7:
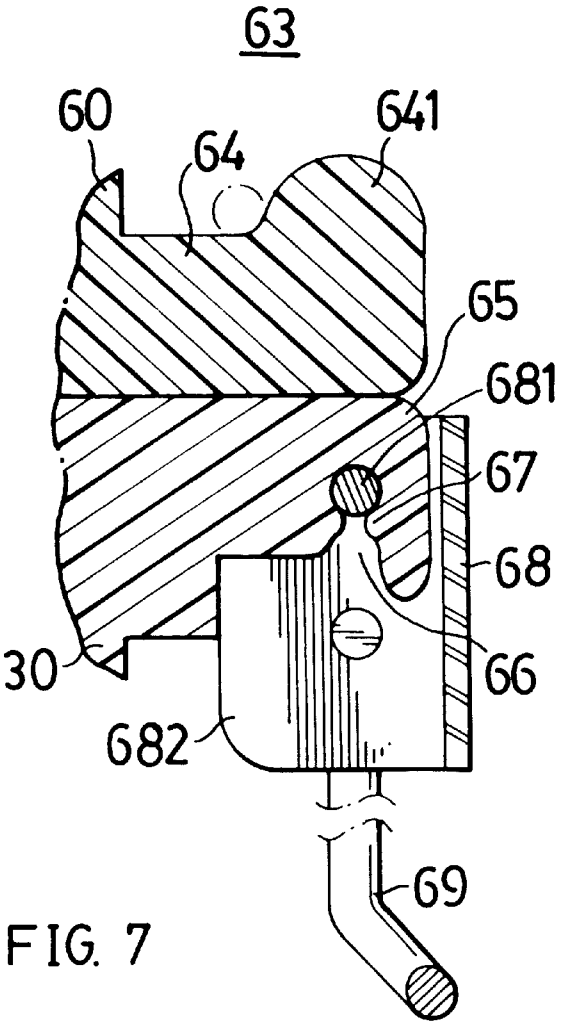
FIG. 7 is a schematic cross-sectional view of the lock and unlock status of a latch fitted between top cove and tray.
Figure 6:
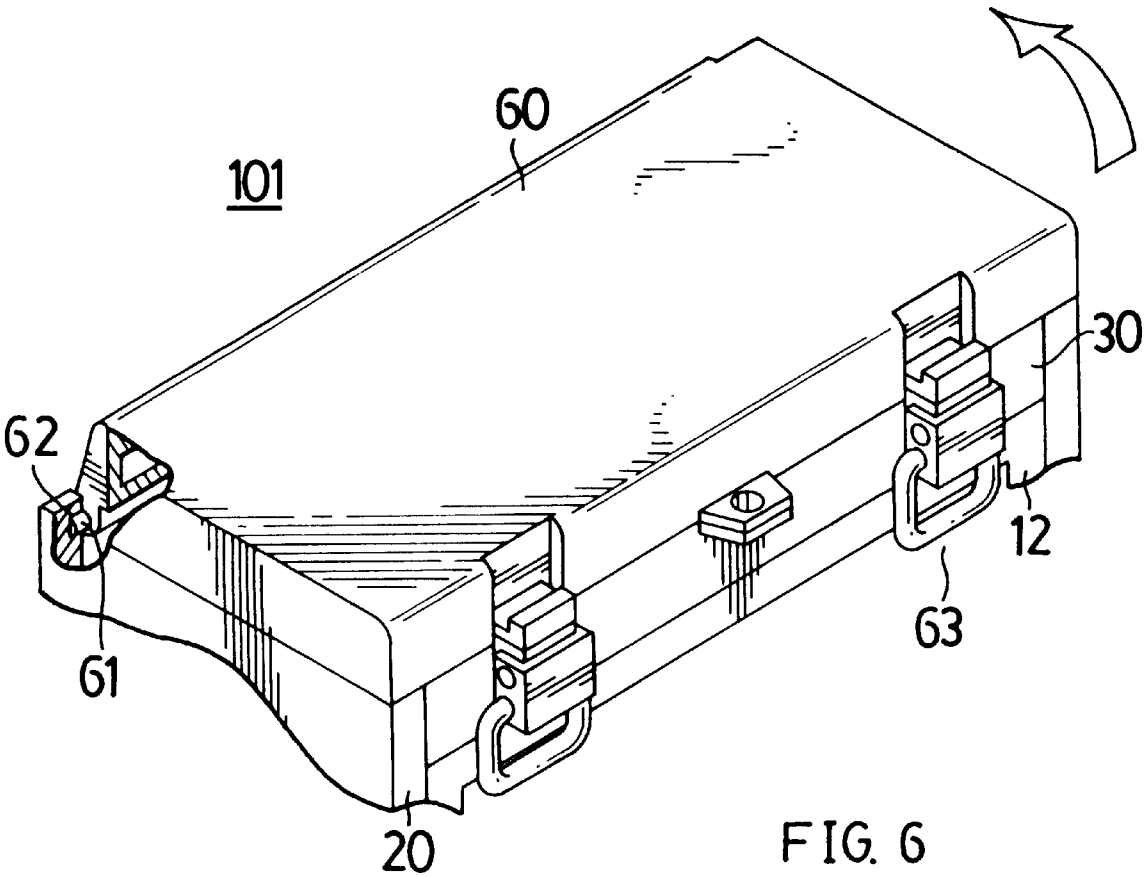
FIG. 6 is a schematic elevational view of a toolbox, that is the tool cabinet of FIG. 2 connect with a top cover.

FIG. 6 is showing a top cover 60 that is jointed on the top of tool cabinet to form a tool box 101. In the figure, the top cover 60 is jointed to pivot groove 62 at two side boards 20 by bolts 61 and can be tumbled to open or close by following the arrow sign. Also, there's a latch device 63 fitted at the close connection point between top cover 60 and tray 30. According to FIG. 7, the latch device 63 consists of:

a. Hook connector 64; it is extended at the edge of top cover 60 and has a stop block 641 fitted above.

b. Hinge plate 65; which is extended at edge of the tray and is corresponding to hook connector. A connecting slot 66 is recessed below it and along the vertical direction of figure. The central part along the two sides of connecting slot 66 has a protruded semi-column or semi-sphere necking block 67.

c. Latch plate 68; which is pierced through and jointed to two side plates 682 by a stretcher 681. This stretcher 681 can pass through the narrow space formed by the opening end of connecting slot 66 and the two symmetric necking blocks 67 and seat itself at the bottom of slot which can enable latch plate 68 to be jointed to hinge plate 65 and access self-revolution movement. Also, two side plates 682 have been externally connected hook ring 69 where can access a self-revolution movement around a fixed center, the stretcher 681, with hinge plate jointed when latch plate 68 is tumbled to open in c.c.w. direction. At this moment, latch can lock top cover 60 and tray 30 by rotating hook ring 69 and place it on the upper part of hook connector 64. And then pressing the latch plate 68 in c. w. direction to its original position where hook ring 69 is being hooked and stopped by stop block 641 (as shown in dash line).

Figure 10:
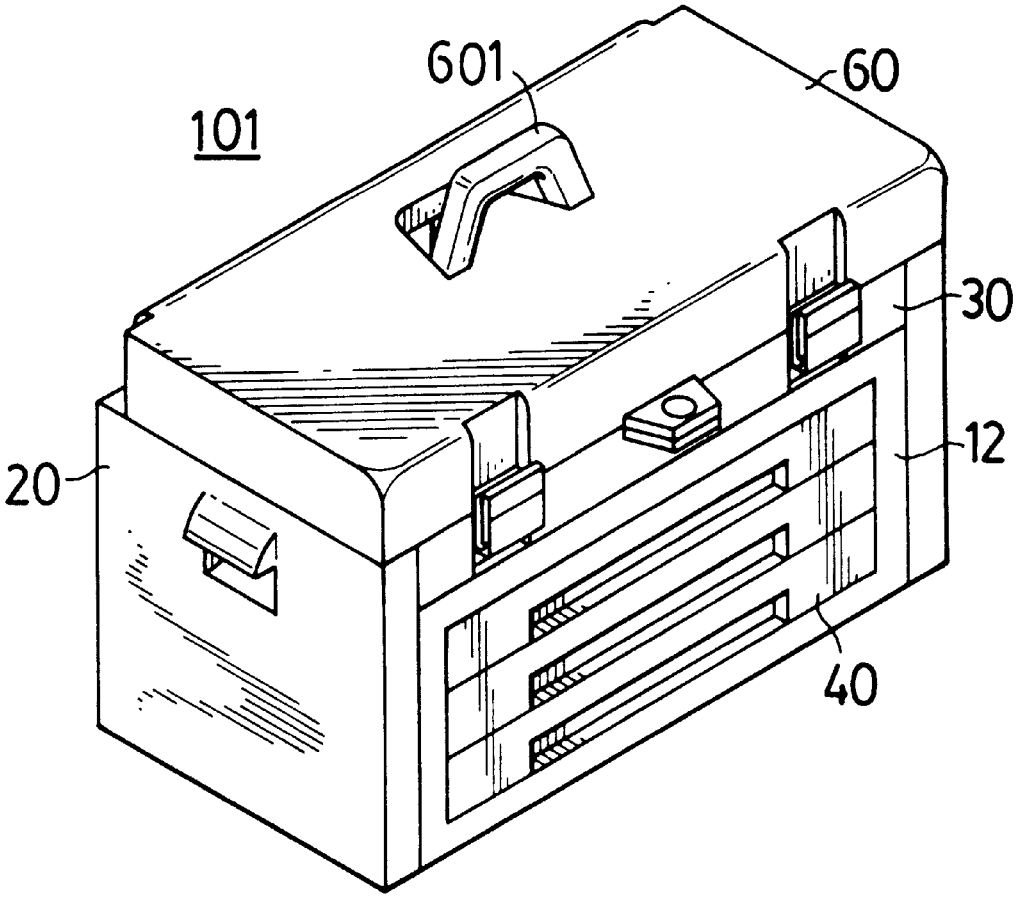
FIG. 10 is a schematic elevational view of another preferred embodiment of the toolbox formed by fitting a top cover with catch to the tool cabinet.

FIG. 10 is showing a toolbox 101 that has an inlaid catch 601 fitted on the top of top cover 60.

Figure 11:
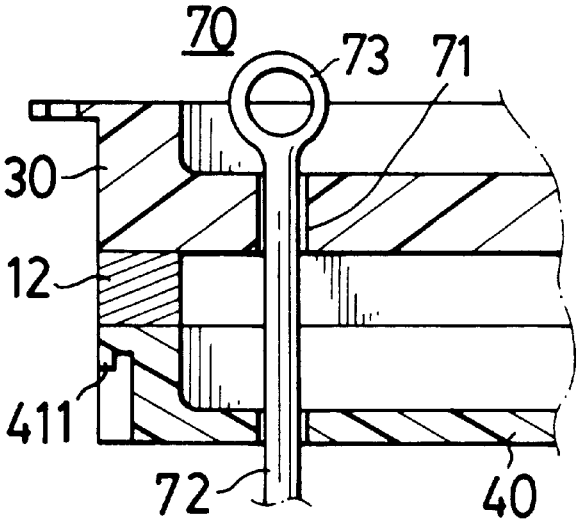
FIG. 11 is a schematic cross-sectional view of the insertion pin pierces through the tray and position the drawers.

FIG. 11 is showing there are piercing holes 71 perforated the corresponding position among individual drawers and tray 30 as described in aforementioned toolbox or tool cabinet. They can let a pin 70 comprised of a rod 72 which has a diameter smaller than piercing holes 71 and a grip 73 with ring-shaped tip end (can be different shape as desired) pass through. Because the tray 30 is firmly secured without any movement; therefore every drawer 40 will be aligned to its position inside the tool box (cabinet). Furthermore, there are handle bar 411 recessed at front of each drawer 40 where fingers can hold.

I claim:

1. A box frame, comprising:

a casing, having a rear board and bottom casing and front frame, they can be incorporated as an integral part and each joint has been fitted with angle that can make the three elements to tumble to fold in vertical status, the front frame and rear board individually having bumps protruded on the two sides of wall, each bump has hook while bottom casing has insertion bump extended at side edge, and a tray, which is surrounded by wall around its tray face as a container and is placed on the upper part of said vertically tumbled and folded casing, there are notches fitted at the corresponding stem bump or protruded bumps while the tray face has coupling bump at notch place, the coupling bump is recessed one or more than one coupling slot with extended insertion bump, and a side board, which is jointed to side edge of said casing and tray, the recessed slot is corresponding to the bumps where joggle slot is fitted to retain hook plate, there are adapting slot erected at the corresponding position to insertion bump as concave and convex match kit, the side board is further fitted a mating bump which is shaped to match the corresponding notch that can be seized at coupling slot by hook plate as an integral part; and a drawers, which is assembled in the side boards of said box frame via front frame to for a complete tool cabinet for usage.

2. An assembly type tool box frame as set forth in claim 1 wherein the insertion bump erected at said tray or bottom casing has a stop that can be extruded into adapting slot, a joggle slot is recessed inside the adapting slot where can seize the stop or use a resistant plate to suppress the stop; this design configuration can reinforce the coupling relation between insertion bump and adapting slot.

3. An assembly type tool box frame as set forth in claim 1 wherein a bracket base amid the elements is extended relevantly at said side board, the bracket base has been fitted several props in equal distance interval along the longitudinal direction, a guide rail is formed in between tow props and in transversely grooved shape; said drawers will be placed onto the opposite guide rails and will be recessed a sliding slot at bottom of both sides that can slide along the props; a handle bar is fitted in the front for griping purpose.

4. An assembly type tool box frame as set forth in claim 3 wherein each prop amid the elements having a positioning block at front and rear end respectively;

a touching block is protruded adjoining the end of sliding slot and is positioned in between two positioning blocks that can function as an end to the drawers push movement or can function to temporarily stop the drawers' pulling movement.

5. An assembly type tool box frame as set forth in claim 1 wherein said tray and drawer individually having a piercing hole, a pin can penetrate these holes one by one to secure the drawers from pulling out; the pin comprises a substantially cylindrical rod having a ring shape or another kind of shape as a grip on end of the rod.

6. An assembly type tool box frame as set forth in claim 1 further comprises a top cover having a bolt which is jointed to pivot groove of said side board to be assembled as a tool box.

7. An assembly type tool box frame as set forth in claim 6 wherein a latch device fitted at the close connection point between the top cover and said tray, the latch device comprising:

a hook connector, which is extended at the edge of the top cover and has a stop block fitted above, and a hinge plate, which is extended at the edge of said tray and is corresponding to the hook connector, a connecting slot is recessed below it and along the vertical direction of figure, the central part along the two sides of connecting slot has a protruded necking block, and a latch plate, which is pierced through and jointed to two side plates by a stretcher and coupled with connecting slot by necking blocks, two side pates have been externally connected hook ring that can be hooked at stop inside the hook connector.

* * * * *